US006543913B2

(12) United States Patent
Fedtchouk

(10) Patent No.: US 6,543,913 B2
(45) Date of Patent: Apr. 8, 2003

(54) PORCELAIN OBJECT AND FABRICATION METHOD

(76) Inventor: Nelli Fedtchouk, 7 East Shore Dr., Princeton, NJ (US) 08540

( * ) Notice: Subject to any disclaimer, the term of this patent is extended or adjusted under 35 U.S.C. 154(b) by 0 days.

(21) Appl. No.: 09/734,747

(22) Filed: Dec. 12, 2000

(65) Prior Publication Data

US 2002/0071282 A1 Jun. 13, 2002

(51) Int. Cl.[7] ..... F21V 11/00

(52) U.S. Cl. ..... 362/351; 264/73; 264/633; 264/636

(58) Field of Search ..... 362/351, 124, 362/808; 264/636, 602, 633, 632, 637, 73, 74

(56) References Cited

U.S. PATENT DOCUMENTS

| | | | | | |
|---|---|---|---|---|---|
| 4,855,259 | A | * | 8/1989 | Claussen et al. | 324/663 |
| 5,164,130 | A | * | 11/1992 | Holcombe et al. | 264/432 |
| 5,868,993 | A | * | 2/1999 | Mintchenko et al. | 264/602 |
| 6,010,235 | A | * | 1/2000 | Sawyer | 362/351 |

* cited by examiner

*Primary Examiner*—Stephen Husar
*Assistant Examiner*—John Anthony Ward
(74) *Attorney, Agent, or Firm*—Schnader Harrison Segal & Lewis LLP; Joan T. Kluger

(57) ABSTRACT

A method of fabricating a porcelain object comprising creating a mold, pouring a first layer of porcelain into the mold, drying the procelain at least partially, applying color to the first porcelain layer, pouring a second layer of porcelain into the mold above the applied color, drying the second porcelain layer at least partially and releasing the porcelain layers from the mold. Also disclosed are a lamp and sculpture fabricated according to the method.

19 Claims, No Drawings

PORCELAIN OBJECT AND FABRICATION METHOD

FIELD OF THE INVENTION

The invention relates to fabrication of porcelain objects.

BACKGROUND OF THE INVENTION

Porcelain is widely used for ornamental objects. To introduce color into a porcelain object, the object is typically painted or glazed. Painted or glazed pieces may be illuminated by shining light on them. The coloring however would at least partially block light shown through the porcelain object. Such coloring methods have been used for hundreds of years. A new look to porcelain object is likely to be a desired change.

SUMMARY OF THE INVENTION

The invention includes a method to create a porcelain object. A mold is first created into which a first layer of porcelain is poured. The porcelain is dried at least partially and then a color is applied to the first layer. A second layer is poured into the mold above the applied color and dried at least partially. The porcelain layers are then released from the mold and dried further if necessary. Objects such as lampshades and lighted sculptures may be fabricated from the method.

DETAILED DESCRIPTION OF THE INVENTION

Disclosed is a novel method of producing porcelain objects. Color is introduced into the object in a unique way providing unusual color effects and enhanced relief. When the porcelain object is illuminated from behind or within a unique color effect occurs. Even without the lighting coloring is achieved very different than the traditional painting or glazing techniques.

In an exemplary embodiment of the invention a porcelain object is fabricated by first creating a mold. A first layer of porcelain is poured into the mold. This layer is dried at least partially. Color is then applied to the first porcelain layer. The color may be left wet or dried at least partially. A second layer of porcelain is poured into the mold above the applied color. The second porcelain layer is dried at least partially and then the porcelain layers are released from the mold. If necessary the porcelain layers may be dried further. After drying the top porcelain object produced is preferably fired. Preferably firing temperature is in a range of about 2000° F. to about 2500° F. and more preferably in the range of about 2100° F. to about 2300° F.

In an illustrative embodiment of the invention the mold is created by creating a drawing on paper. The drawing is then transferred onto a plate such as a gypsum plate. The plate may then be carved according to the drawing.

The porcelain layers may be any thickness desired. Varying thicknesses will produce different color effects. A particularly pleasing effect may be obtained by applying the first layer to a height in the range of about 4 mm to about 6 mm and more preferably in a range of abour 3 mm to about 5 mm. A similar height is desirable for the second layer of porcelain.

In one embodiment of the invention after each layer is at least partially dried, undried porcelain is poured off and the porcelain is then allowed to dry until substantially no wet spots are visible.

Any type of color may be applied provided that it is compatible with the porcelain and any drying or firing techniques used. An illustrative example is undergiazed paint.

It is also advantageous to substantially cover kiln shelves with alumina hydrate at least in the areas that come in contact with the layered porcelain.

The method may be used to form a single object or to form a plurality of objects that are jointed together. A plurality of porcelain and color layers may be used. Each subsequent porcelain layer may cover some or all of previous layers. Any combination of colors or types of color may be used.

The invention is particularly suitable to objects such as lampshades or lighted sculptures. The use of light behind the porcelain object enhances the release and the color effect achieved.

A lampshade may be fabricated, for example, by producing a plurality of the porcelain objects and joining them together. They may also be interspersed with porcelain or other material objects that are not manufactured by the methods described herein. In one embodiment of the invention the porcelain objects are joined together by a stained glass joining technique which is well known in the art.

A lighted sculpture may be fabricated according to methods described herein. The sculpture would have a cavity able to accommodate a light therein. The light may be for example, an electric light or a candle.

While the invention has been described by illustrative embodiments, additional advantages and modifications will be apparent to those skilled in the art. Therefore, the invention in its broader aspects is not limited to specific details shown and described herein. Modifications, for example, to the types of objects, types of color material or object joining techniques, may be made without departing from the spirit and scope of the invention. Accordingly it is intended that the invention not be limited to the specific illustrative embodiments but be interpreted within the full spirit and scope of the appended claims and their equivalents.

What is claimed is:

1. A method of fabricating a porcelain object comprising:

a. creating a mold;

b. pouring a first layer of porcelain into the mold;

c. drying the porcelain at least partially;

d. applying color to the first porcelain layer, wherein the color is not a porcelain layer;

e. pouring a second layer of porcelain into the mold above the applied color;

f. drying the second porcelain layer at least partially;

g. releasing the porcelain layers from the mold;

h. firing the porcelain layers.

2. The method of claim 1 wherein after the porcelain layers are released from the mold they are dried further.

3. The method of claim 1 wherein the layered porcelain is fired at a temperature in a range of about 2100° F. to about 2300° F.

4. The method of claim 1 wherein the mold is created by creating a drawing on paper; transferring the drawing onto a gypsum plate; and carving the gypsum plate according to the drawing.

5. The method of claim 1 wherein the first layer is poured into the mold to a height in the range of about 3 mm to about 5 mm.

6. The method of claim 1 further comprising pouring off undried porcelain from the first layer and allowing the porcelain to dry until substantially no wet spots are visible.

7. The method of claim 1 wherein the color applied is undergiazed paint.

8. The method of claim 1 further comprising pouring off undried porcelain from the second porcelain layer and allowing the porcelain to dry until substantially no wet spots are visible.

9. The method of claim 1 wherein kiln shelves on which the layered porcelain is placed during firing are substantially covered with alumina hydrate at least in areas that come in contact with the layered porcelain.

10. The method of claim 1 further comprising joining a plurality of the layered porcelain objects together.

11. A lamp shade wherein at least a portion is fabricated according to the method of claim 1.

12. The lamp shade of claim 11 comprising a plurality of the porcelain objects joined together.

13. The lamp shade of claim 12 wherein the objects are joined by a stained glass joining technique.

14. A lighted sculpture fabricated according to claim 1.

15. The lighted sculpture of claim 14 wherein the sculpture has a cavity for accommodating a light therein.

16. The sculpture of claim 13 wherein the cavity accommodates a light selected from the group comprising, electric and candle.

17. A lamp wherein at least a portion is fabricated according to claim 1.

18. A porcelain object comprising:

a first layer of porcelain;

a colored layer above the first porcelain layer; and a second porcelain layer above the colored layer, wherein the color is not a porcelain layer.

19. A porcelain object fabricated according to the method of claim 1.

* * * * *